US005238238A

United States Patent [19]

Shinohara et al.

[11] Patent Number: 5,238,238

[45] Date of Patent: Aug. 24, 1993

[54] PAPER FEEDING CASSETTE CASE IN IMAGE FORMING APPARATUS

[75] Inventors: Masahiro Shinohara, Hirakata; Hiromi Okada, Nara; Hideaki Tomita, Osaka; Naoyuki Ishida, Osaka; Makoto Eki, Osaka; Masao Otsuka, Osaka, all of Japan

[73] Assignee: Mita Industrial Co., Ltd., Japan

[21] Appl. No.: 957,017

[22] Filed: Oct. 6, 1992

[30] Foreign Application Priority Data

Oct. 17, 1991 [JP] Japan ..... 3-298223

[51] Int. Cl.[5] ..... B65H 1/00

[52] U.S. Cl. ..... 271/145; 271/171; 271/255

[58] Field of Search ..... 271/127, 255, 145, 171

[56] References Cited

U.S. PATENT DOCUMENTS 4,343,461 8/1982 Tominori ..... 271/171 X
4,382,674 5/1983 Miyoshi ..... 271/171 X
4,697,803 10/1987 Kan ..... 271/255 X

*Primary Examiner*—Richard A. Schacher
*Attorney, Agent, or Firm*—Beveridge, DeGrandi, Weilacher & Young

[57] ABSTRACT

A paper feeding cassette case in an image forming apparatus according to the present invention is so adapted that an arbitrary internal unit out of a plurality of types of internal units including at least one internal unit of a universal type having a structure in which paper sheets of a plurality of sizes requiring the switching of the printing ranges can be set can be attached thereto. In the paper feeding cassette case, detecting member mounting portions are respectively formed in different positions respectively corresponding to the types of internal units, and the detecting member and each of the detecting member mounting portions are provided with mounting member for detachably mounting the detecting member on the detecting member mounting portion. In addition, the mounting member provided for the detecting member mounting portion corresponding to the internal unit of a universal type has a structure in which the detecting member is allowed to slide in the range of the detecting member mounting portion.

7 Claims, 6 Drawing Sheets

PAPER FEEDING CASSETTE CASE IN IMAGE FORMING APPARATUS

BACKGROUND OF THE INVENTION

1. Field of the Invention

The present invention relates to a paper feeding cassette case in a paper feeding cassette used in an image forming apparatus such as a facsimile, a copying machine, a printer or the like.

2. Description of the Prior Art

A paper feeding cassette of a so-called universal type in which paper sheets of a plurality of sizes can be set has been conventionally known. As this type of paper feeding cassette, a paper feeding cassette in an image forming apparatus having a paper size detecting member movably provided so as to give an indication of the size of paper sheets set therein to a control section of the image forming apparatus and a detector for detecting the position of the paper size detecting member to detect the size of the paper sheets provided on the side of the main body of the image forming apparatus has been developed (see Japanese Utility Model Laid-Open Gazette No. 174334/1989).

Meanwhile, a paper feeding cassette for setting envelopes and a paper feeding cassette for setting plain paper sheets, including paper feeding cassette cases, have been conventionally separately manufactured. The applicant of the present invention has developed the manufacture of a paper feeding cassette for envelopes and a paper feeding cassette for plain paper sheets by using as a paper feeding cassette case for setting envelopes and a paper feeding cassette case for setting plain paper sheets ones having the same structure and mounting an internal unit for envelopes and an internal unit for plain paper sheets on the cases having the same structure so as to reduce the manufacturing cost of the paper feeding cassettes.

In such a paper feeding cassette, an indication as to whether the paper feeding cassette is a paper feeding cassette for envelopes or a paper feeding cassette for plain paper sheets must be given to the control section of the image forming apparatus. In addition, if the paper feeding cassette for plain paper sheets can set paper sheets of a plurality of sizes, an indication of the size of the paper sheets set must be also given to the control section of the image forming apparatus.

An object of the present invention is to provide a paper feeding cassette case in an image forming apparatus to which a plurality of types of internal units can be attached, which can give indications of the type of internal unit and the size of paper sheets to a control section of the image forming apparatus and makes it easy for an operator to set a paper type detecting member in a suitable position without an erroneous operation.

SUMMARY OF THE INVENTION

A paper feeding cassette case in a first image forming apparatus according to the present invention to which an arbitrary internal unit out of a plurality of types of internal units including at least one internal unit of a universal type having a structure in which paper sheets of a plurality of sizes requiring switching of the printing ranges can be set can be attached and on which a detecting member for giving indications of the type of internal unit and the size of paper sheets to the main body of the image forming apparatus is mounted is characterized in that detecting member mounting portions are respectively formed in different positions respectively corresponding to the types of internal units in the above-mentioned paper feeding cassette case, the above-mentioned detecting member and each of the above-mentioned detecting member mounting portions are provided with mounting means for detachably mounting the detecting member on the detecting member mounting portion, and the above-mentioned mounting means provided for the detecting member mounting portion corresponding to the above-mentioned internal unit of a universal type has a structure in which the above-mentioned detecting member is allowed to slide in the range of the detecting member mounting portion.

The above-mentioned internal units are of two types: an internal unit for envelopes for setting envelopes and an internal unit for plain paper sheets serving as an internal unit of a universal type in which two or more types of plain paper sheets of different sizes can be set. A magnet, for example, is used as the above-mentioned detecting member. The above-mentioned mounting means provided for the above-mentioned detecting member and each of the above-mentioned detecting member mounting portions comprise, for example, an engaging claw provided for the detecting member and an engaging hole provided for the detecting member mounting portion and detachably engaged with the engaging claw. The engaging hole provided for the detecting member mounting portion corresponding to the above-mentioned internal unit of a universal type is, for example, a long narrow hole so extend in a predetermined direction that the above-mentioned detecting member is allowed to slide in a state where the above-mentioned engaging claw is engaged with the above-mentioned engaging hole.

The detecting member is mounted on the detecting member mounting portion corresponding to the internal unit attached to the paper feeding cassette case. Accordingly, the type of internal unit attached can be detected depending on the position of the detecting member. When the internal unit attached is an internal unit of a universal type in which paper sheets of a plurality of sizes requiring switching of the printing ranges can be set, the detecting member can be slidably mounted on the detecting member mounting portion corresponding to the internal unit. Accordingly, the type of internal unit attached and the size of paper sheets set can be detected depending on the position of the detecting member by moving the detecting member in conformity with the size of paper sheets set.

Furthermore, after the detecting member is mounted on the detecting member mounting portion corresponding to the internal unit, the detecting member is prevented from being mounted on the detecting member mounting portion corresponding to a different internal unit by an operator. In addition, when the internal unit attached is an internal unit of a universal type, the detecting member is allowed to slide to adjust the position of the detecting member to a position corresponding to the size of paper sheets, thereby to make it easy to set the detecting member in a suitable position without an erroneous operation.

A paper feeding cassette case in a second image forming apparatus according to the present invention to which an arbitrary internal unit out of an internal unit for plain paper sheets having a structure in which paper sheets of a plurality of sizes requiring the switching of the printing ranges can be set and an internal unit for envelopes for setting envelopes can be attached and on which a detecting member for giving indications of the type of internal unit and the size of paper sheets to the main body of the image forming apparatus is characterized in that detecting member mounting portions are respectively formed in different positions respectively corresponding to the above-mentioned two types of internal units in the above-mentioned paper feeding cassette case, the above-mentioned detecting member and each of the above-mentioned detecting member mounting portions are provided with mounting means for detachably mounting the detecting member on the detecting member mounting portion, and the above-mentioned mounting means provided for the detecting member mounting portion corresponding to the above-mentioned internal unit for plain paper sheets has a structure in which the above-mentioned detecting member is allowed to slide toward different positions corresponding to the sizes of the paper sheets which can be set in the above-mentioned internal unit for plain paper sheets in the range of the detecting member mounting portion.

A magnet, for example, is used as the above-mentioned detecting member. The above-mentioned mounting means provided for the above-mentioned detecting member and each of the above-mentioned detecting member mounting portions comprise, for example, an engaging claw provided for the detecting member and an engaging hole provided for the detecting member mounting portion and detachably engaged with the engaging claw. The engaging hole provided for the detecting member mounting portion corresponding to the above-mentioned internal unit for plain paper sheets is, for example, a long narrow hole so extend in a predetermined direction that the above-mentioned detecting member is allowed to slide in a state where the above-mentioned engaging claw is engaged with the above-mentioned engaging hole.

Since the detecting member is mounted on the detecting member mounting portion corresponding to the internal unit attached to the paper feeding cassette case, it can be judged whether the internal unit attached is an internal unit for plain paper sheets or an internal unit for envelopes depending on the position of the detecting member. When the internal unit attached is an internal unit for plain paper sheets, the detecting member is slidably mounted on the detecting member mounting portion corresponding to the internal unit. Accordingly, the type of internal unit attached and the size of paper sheets set can be judged depending on the position of the detecting member by moving the detecting member in conformity with the size of paper sheets set.

Furthermore, after the detecting member is mounted on the detecting member mounting portion corresponding to the internal unit, the detecting member is prevented from being mounted on the detecting member mounting portion corresponding to a different internal unit by an operator. In addition, when the internal unit attached is an internal unit for plain paper sheets, the detecting member is allowed to slide to adjust the position of the detecting member to a position corresponding to the size of paper sheets, thereby to make it easy to set the detecting member in a suitable position without an erroneous operation.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Description is now made of an embodiment of the present invention with reference to the drawings.

Figure 1:
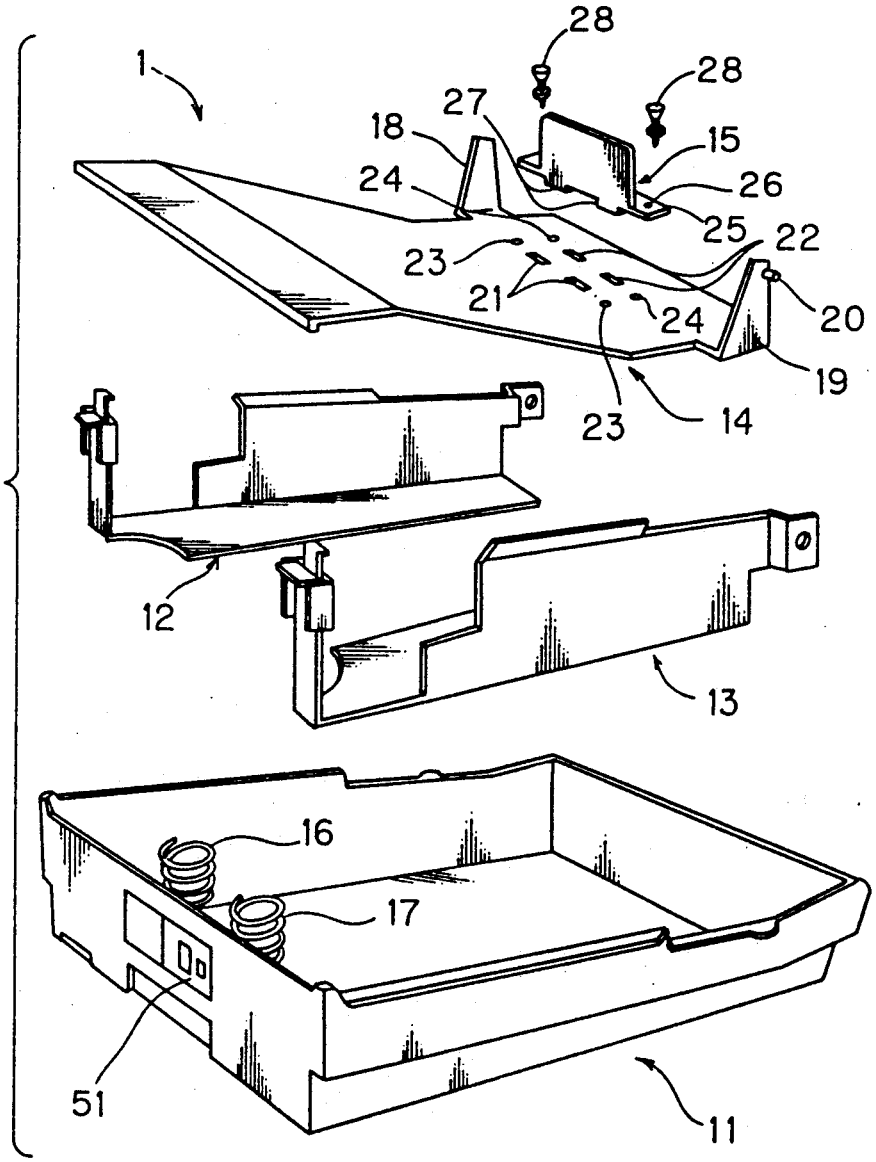
FIG. 1 is an exploded perspective view illustrating a paper feeding cassette for plain paper sheets.

FIG. 1 illustrates the construction of a paper feeding cassette for plain paper sheets 1.

This paper feeding cassette for plain paper sheets 1 comprises a case 11, an internal unit attached to the case, and a case cover (not shown). The internal unit has a structure in which paper sheets of A4 size and paper sheets of Folio size as wide as and slightly longer than the paper sheets of A4 size can be set.

The internal unit comprises a pair of right and left paper side end defining plates 12 and 13 provided in the case 11 and screwed into the bottom wall of the case 11, a paper setting plate 14 provided in the case 11 and having its rear end rotatably mounted on the paper side end defining plates 12 and 13, a paper rear end defining plate 15 mounted on the paper setting plate 14, and a pair of right and left coil springs 16 and 17 arranged between the bottom surface of the case 11 and the front on the lower surface of the paper sheet setting plate 14.

Flanges 18 and 19 projected upward are formed on both sides in the rear end of the paper setting plate 14. The flanges 18 and 19 are rotatably mounted on the corresponding paper side end defining plates 12 and 13 by pins 20. A pair of right and left holes for positioning a rear end defining plate for paper sheets of A4 size 21 and a pair of right and left holes for positioning a rear end defining plate for paper sheets of Folio size 22 are formed with spacing in the longitudinal direction in the rear end of the paper setting plate 14. Pin fitting holes 23 are formed on both sides of the pair of right and left holes for positioning a rear end defining plate for paper sheets of A4 size 21. Pin fitting holes 24 are also formed on both sides of the pair of right and left holes for positioning a rear end defining plate for paper sheets of Folio size 22.

The paper sheet rear end defining plate 15 has a backward folded portion 25 in its lower end, and pin inserting holes 26 are formed on both ends of the backward folded portion 25. In addition, a pair of right and left positioning downward projections 27 is formed in the lower end of the paper rear end defining plate 15. When paper sheets of A4 size are set in the paper feeding cassette 1, the positioning downward projections 27 are fitted in the holes for positioning a rear end defining plate for paper sheets of A4 size 21, and pins 28 are fitted in the pin fitting holes 23 from above the pin inserting holes 26, so that the paper rear end defining plate 15 is mounted on the paper setting plate 14. When the paper sheets of Folio size are set in the paper feeding cassette 1, the positioning downward projections 27 are fitted in the holes for positioning a rear end defining plate for paper sheets of Folio size 22, and the pins 28 are fitted in the pin fitting holes 24 from above the pin inserting holes 26, so that the paper rear end defining plate 15 is mounted on the paper setting plate 14.

Figure 2:
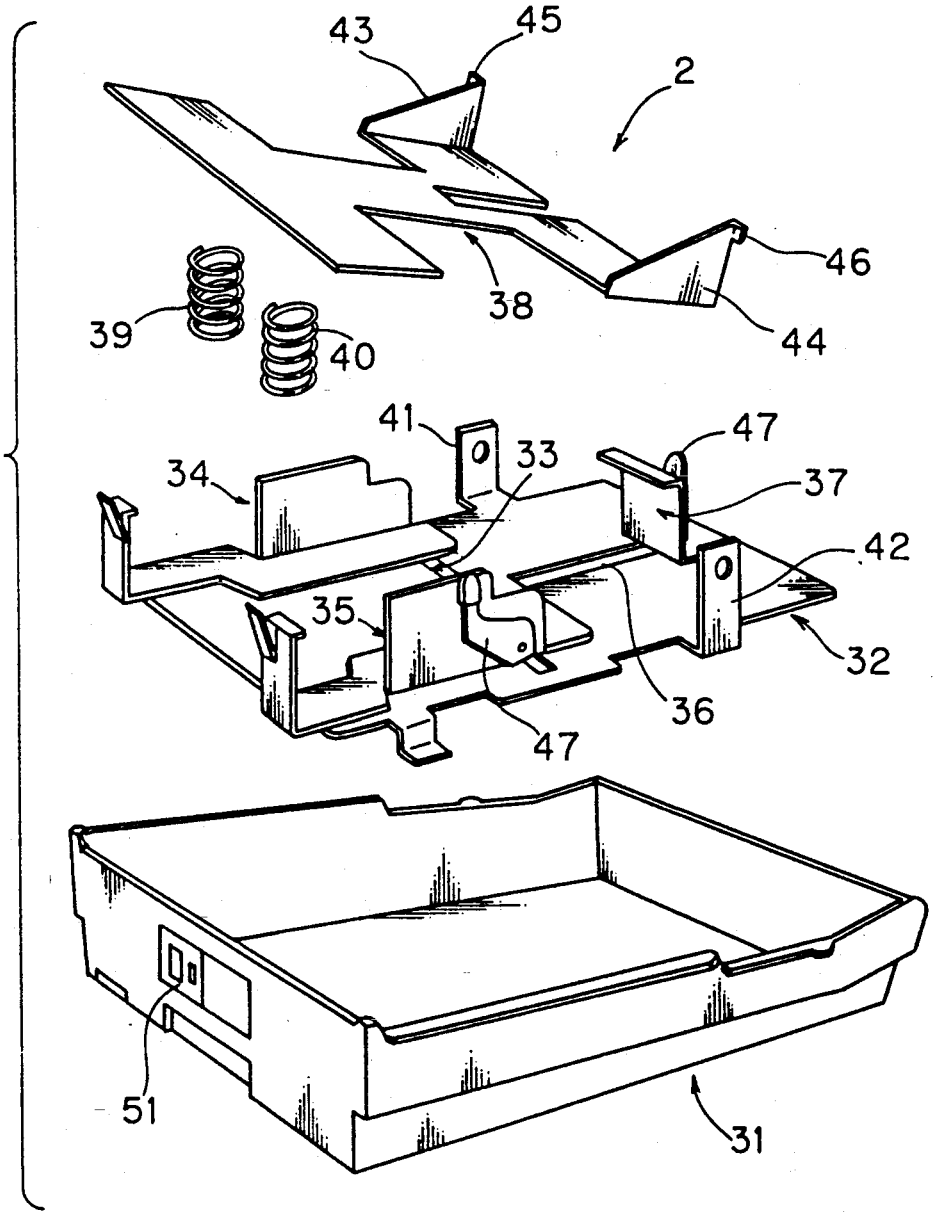
FIG. 2 is an exploded perspective view illustrating a paper feeding cassette for envelopes.

FIG. 2 illustrates the construction of a paper feeding cassette for envelopes 2.

This paper feeding cassette for envelopes 2 comprises a case 31, an internal unit attached to the case 31, and a case cover (not shown). The internal unit has a structure in which envelopes of a plurality of sizes can be set.

The internal unit comprises a substrate 32 provided in the case 31 and screwed into the bottom wall of the case 31, a pair of right and left paper side end defining plates 34 and 35 mounted on the substrate 32 movably near to and away from each other along a guide hole 33 formed in the substrate 32, a paper rear end defining plate 37 mounted on the substrate 32 movably back and forth along the guide hole 36 formed in the substrate 32, a paper setting plate 38 provided in the case 11 and having its rear end movably mounted on the substrate 32, and a pair of right and left coil sprints 39 and 40 arranged between the substrate 32 and the front on the lower surface of the paper setting plate 38.

Flanges 41 and 42 projected upward are formed on both sides near the rear end of the substrate 32. Flanges 43 and 44 projected upward are formed on both sides in the rear end of the paper setting plate 38. Outward projections 45 and 46 are formed in upper rear ends of the respective flanges 43 and 44, and the respective outward projections 45 and 46 are loosely fitted in holes formed in the corresponding flanges 41 and 42 of the substrate 32.

The pair of right and left paper side end defining plates 34 and 35 are connected to each other movably near to and away from each other through racks respectively mounted on the paper side end defining plates 34 and 35 and a pinion (not shown) rotatably mounted on the substrate 32 and engaged with both the racks. Each of the paper side end defining plates 34 and 35 and the pages rear end defining plate 37 are provided with a fixing mechanism (not shown) for releasably fixing them in arbitrary positions in the moving range. Each of the fixing mechanisms is provided with an operation lever 47 for operating the fixing mechanism.

When envelopes are set in the paper feeding cassette for envelopes 2, the positions of the paper side end defining plates 34 and 35 are so adjusted that the spacing between the paper side end defining plates 34 and 35 is approximately equal to the width of the envelopes to be set and the position of the paper rear end defining plate 37 is so adjusted as to be a position corresponding to the length of the envelopes to be set.

The case 31 of the paper feeding cassette for envelopes 2 and the case 11 of the paper feeding cassette for plain paper sheets 1 have exactly the same structure. A paper size detecting member holding body 51 is detachably mounted on the front surface of each of the cases 11 and 31.

Figure 3:
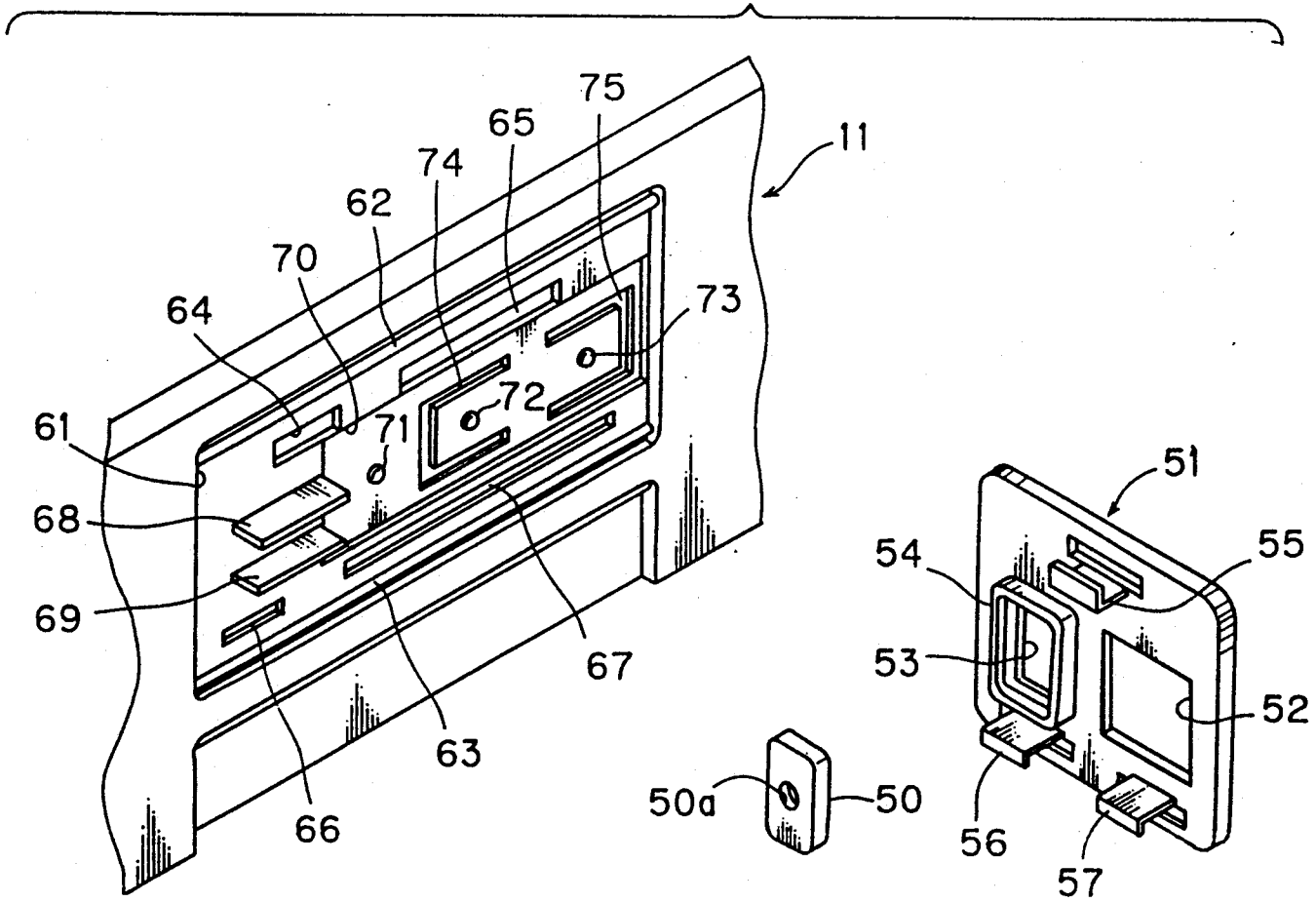
FIG. 3 is an exploded perspective view illustrating the front of a paper feeding cassette case and a paper size detecting member holding body.

FIG. 3 illustrates the front surface of the case 11 (the same is true for the case 31) and the paper size detecting member holding body 51.

The paper size detecting member holding body 51 is in a square plate shape, and has two windows 52 and 53 formed side by side in the lateral direction. A rectangular frame 54 is formed on the rear surface of the detecting member holding body 51 so as to surround the window 53 on the right side, and a rectangular plate-shaped magnet 50 which is a paper size detecting member is fitted in the frame 54. A hole **50*a* is formed in the center of the magnet 50. An upper claw 55 projected backward and having its forward end folded upward and a pair of right and left lower claws 56 and 57 projected backward and having its forward end folded downward are respectively provided in the center of the width of the upper part and on both sides of the lower part on the rear surface of the detecting member holding body 51**.

A first concave portion 61 which is rectangular or ablong as viewed from the front is formed on the front surface of each of the cases 11 and 31. The length of the first concave portion 61 is approximately equal to the length of one side of the detecting member holding body 51, and the width of the first concave portion 61 is slightly larger than twice the length of one side of the detecting member holding body 51. In addition, the depth of the first concave portion 61 is approximately equal to the thickness of the detecting member holding body 51.

Projections 62 and 63 extending in the lateral direction are formed in the upper part and the lower part on the bottom surface of the first concave portion 61. A first upper claw fitting hole 64 near the left end of the first concave portion 61 and a second upper claw fitting hole 65 extending toward the right from the center of the width of the first concave portion 61 are respectively formed below the upper projection 62 on the bottom surface of the first concave portion 61. A first lower claw fitting hole 66 extending toward the left from the position below the left end of the first upper claw fitting hole 64 and a second lower claw fitting hole 67 extending toward the right from the position below the right end of the first upper claw fitting hole 64 are respectively formed above the lower projection 63 on the bottom surface of the first concave portion 61.

A pair of upper and lower oblong projections 68 and 69 and a second concave portion 70 which is oblong or rectangular as viewed from the front are respectively formed near the left end and between the right ends of the oblong projections 68 and 69 and the right end of the concave portion 61 are respectively formed in the position between the upper claw fitting holes 64 and 65 and the lower claw fitting holes 66 and 67 on the bottom surface of the first concave portion 61. The length of each of the oblong projections 68 and 69 is slightly smaller than the width of the window 52 of the detecting member holding body 51. The length of the second concave portion 70 is approximately equal to the length of the frame 54 of the detecting member holding body 51. In addition, the depth of the second concave portion 70 is approximately equal to the length of the projected part of the frame 54.

Three hemispherical projections 71, 72 and 73 are formed with spacing in the lateral direction on the bottom surface of the second concave portion 70. In addition, a notch 74 which is in an inverted shape as viewed from the front and a notch which is in a shape as viewed from the front are respectively formed in the periphery of the projection 72 in the center and in the periphery of the projection 73 on the right side on the bottom surface of the second concave portion 70.

Figure 4:
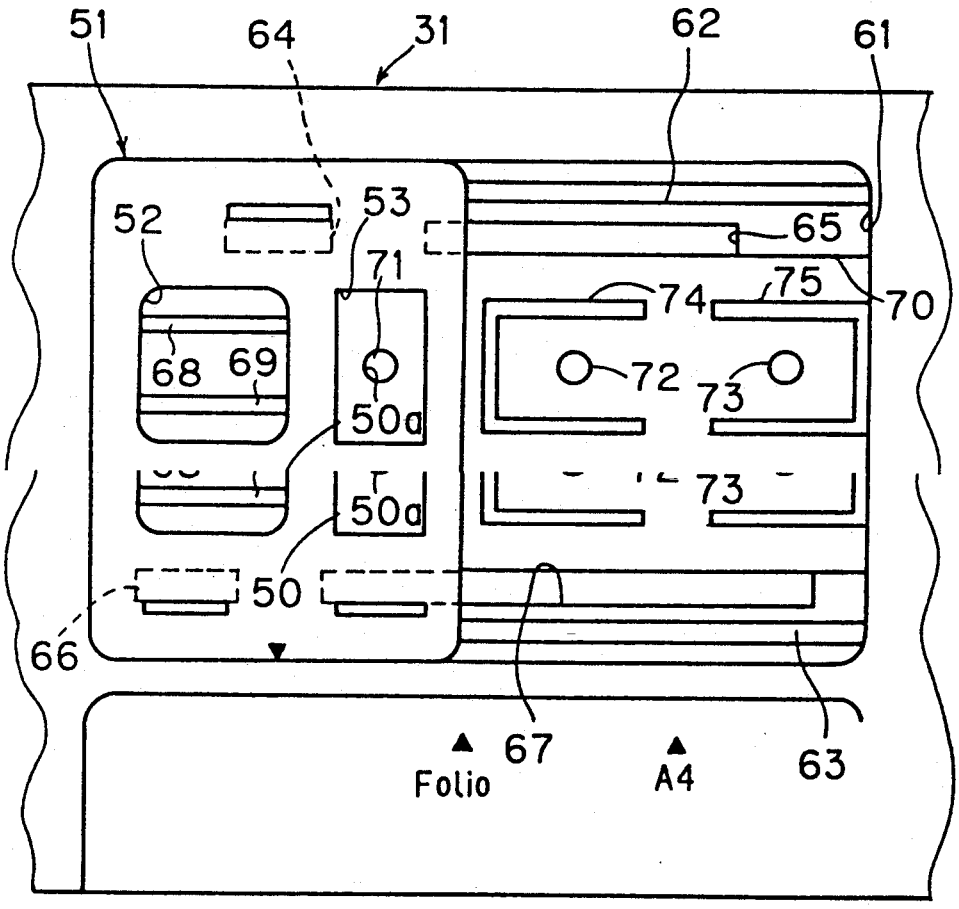
FIG. 4 is an exploded front view illustrating the position where a detecting member holding body is mounted in a case where the paper feeding cassette is a paper feeding cassette for envelopes.

When the paper feeding cassette is the paper feeding cassette for envelopes 2, the detecting member holding body 51 is fitted in a portion on the left side of the first concave portion 61 and fixed thereto, as shown in FIG. 4. That is, the upper claw 55 of the detecting member holding body 51, the lower claw 56 on the left side, and the lower claw 57 on the right side are respectively fitted in the first upper claw fitting hole 64, the first lower claw fitting hole 66, and the second lower claw fitting hole 67, and the forward ends of the respective claws 55, 56 and 57 are engaged with the rear surface of the front wall of the case 31. In addition, the oblong projections 68 and 69 on the front surface of the case 31 are fitted in the window 52 of the detecting member holding body 51. Furthermore, the hemispherical projection 71 on the left side is fitted in the hole 50*a* of the magnet 50.

In this state, even if an attempt to cause the detecting member holding body 51 to slide in the first concave portion 61 is made, the detecting member holding body 51 is not allowed to slide because the oblong projections 68 and 69 are fitted in the window 52 of the detecting member holding body 51.

Figure 5:
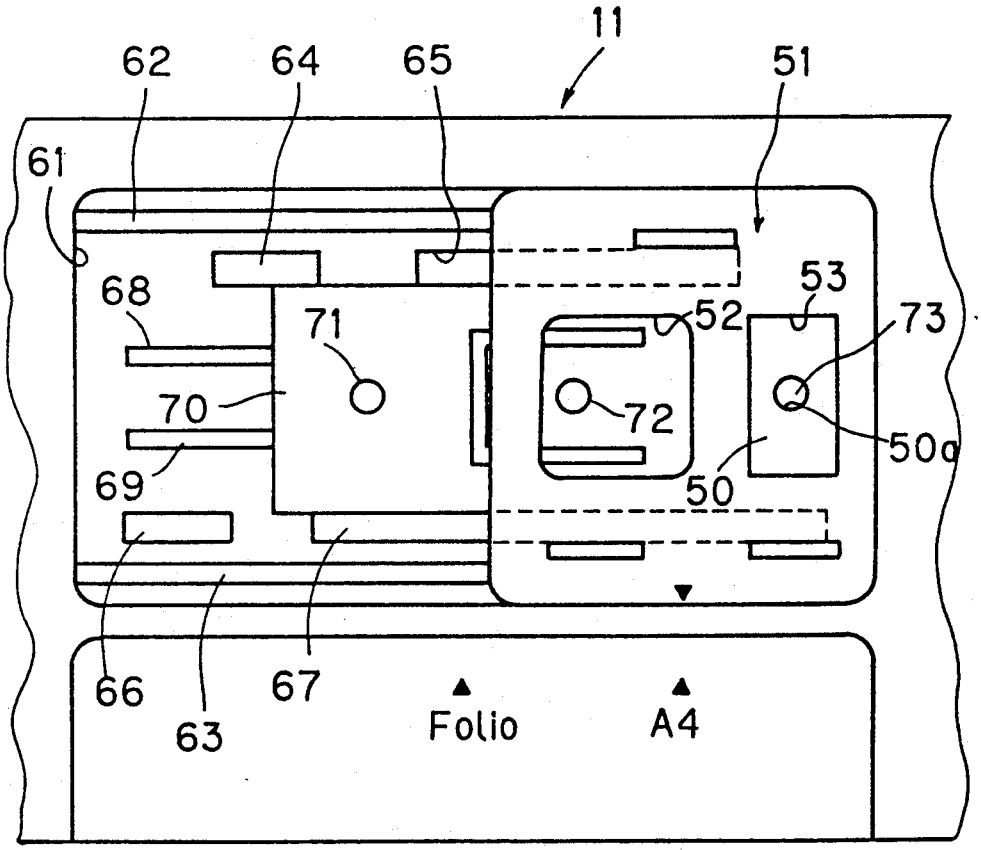
FIG. 5 is an exploded front view illustrating the position where a detecting member holding body is mounted in a case where the paper feeding cassette is a paper feeding cassette for plain paper sheets and paper sheets of A4 size are set.
Figure 6:
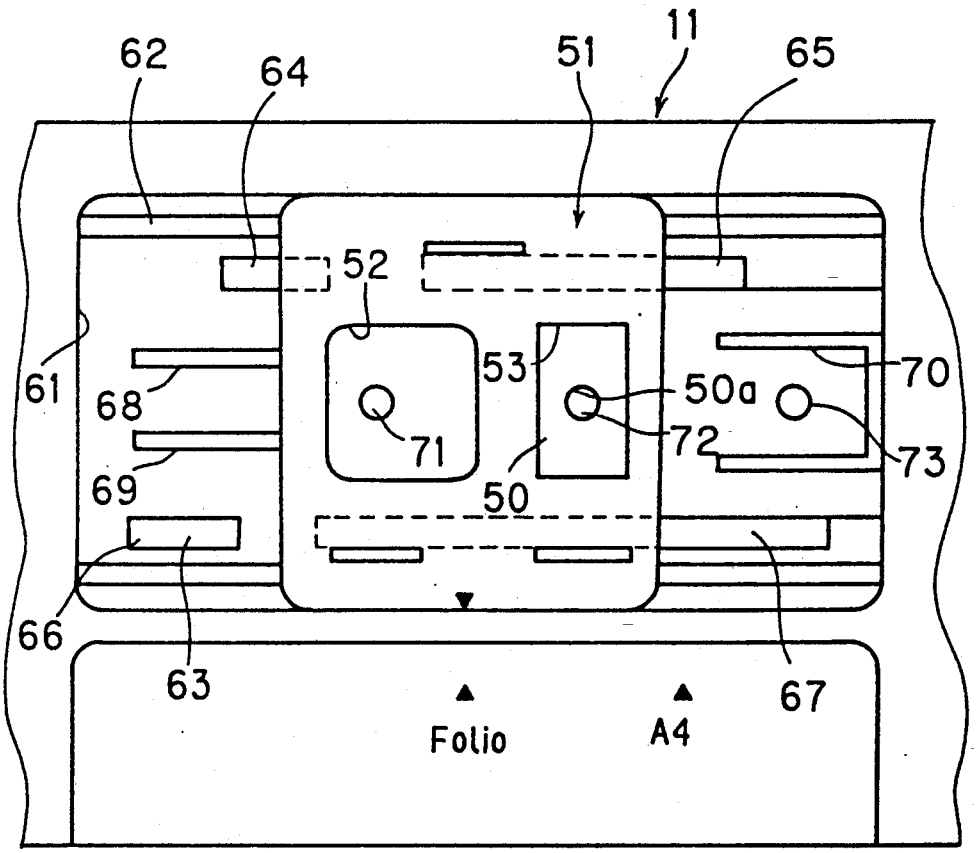
FIG. 6 is an exploded front view illustrating the position where a detecting member holding body is mounted in a case where the paper feeding cassette is a paper feeding cassette for plain paper sheets and paper sheets of Folio size are set.

When the paper feeding cassette is the paper feeding cassette for plain paper sheets 1, the detecting member holding body 51 is fitted in a portion on the right side from the oblong projections 68 and 69 of the first concave portion 61, as shown in FIGS. 5 or 6. In this case, the upper claw 55 of the detecting member holding body 51, and the right and left lower claws 56 and 57 are respectively fitted in the second upper claw fitting hole 64 and the second lower claw fitting hole 67, and the respective forward ends of the claws 55, 56 and 57 are engaged with the rear surface of the front wall of the case 11.

When paper sheets of A4 size are set in the paper feeding cassette for plain paper sheets 1, the detecting member holding body 51 is caused to slide toward the right, to fix the detecting member holding body 51 to the portion on the right side of the first concave portion 61, as shown in FIG. 5. In this case, the hemispherical projection 73 on the right side is fitted in the hole 50*a* of the magnet 50.

When paper sheets of Folio size are set in the paper feeding cassette for plain paper sheets 1, the detecting member holding body 51 is caused to slide toward the left, to fix the detecting member holding body 51 to the position just on the right side from the oblong projections 68 and 69 of the first concave portion 61, as shown in FIG. 6. In this case, the hemispherical projection 72 in the center is fitted in the hole 50*a* of the magnet 50.

When the detecting member holding body 51 is thus mounted on the portion on the right side from the oblong projections 68 and 69 of the first concave portion 61 with its one end being fitted therein, the detecting member holding body 51 is slidably moved between the fixed position for paper sheets of A4 size as shown in FIG. 5 and the fixed position for paper sheets of Folio size as shown in FIG. 6. However, the detecting member holding body 51 is not slidably moved to the fixed position for envelopes shown in FIG. 4. Consequently, after the detecting member holding body 51 is fitted once and mounted on the portion on the right side from the oblong projections 68 and 69 of the first concave portion 61 in the paper feeding cassette for plain paper sheets 1, the detecting member holding body 51 is prevented from being erroneously mounted on the fixed position for envelopes by an operator. Moreover, the position of the detecting member holding body 51 can be switched between the fixed position for paper sheets of A4 size and the fixed position for paper sheets of Folio size.

Similarly, after the detecting member holding body 51 is fitted once and mounted on the portion on the left side of the first concave portion 61 in the paper feeding cassette for envelopes 2, the detecting member holding body 51 is prevented from being erroneously mounted on the fixed position for plain paper sheets by an operator.

Meanwhile, a detector for detecting the position of the magnet 50 held by the detecting member holding body 51 is provided on the side of the main body of an image forming apparatus such as a copying machine, a printer or the like on which the paper feeding cassette 1 or 2 is mounted. The position of the magnet 50 is detected by the detector. Consequently, a control portion of the image forming apparatus can judge the type of paper feeding cassette, that is, the type of internal unit and the size of paper sheets set in the paper feeding cassette.

The foregoing and other objects, features, aspects and advantages of the present invention will become more apparent from the following detailed description of the present invention when taken in conjunction with the accompanying drawings.

What is claimed is:

1. A paper feeding cassette case in an image forming apparatus to which an arbitrary internal unit out of a plurality of types of internal units including at least one internal unit of a universal type having a structure in which paper sheets of a plurality of sizes requiring switching of the printing ranges can be set can be attached and on which a detecting member for giving indications of the type of internal unit and the size of paper sheets to the main body of the image forming apparatus is mounted, wherein detecting member mounting portions are respectively formed in different positions respectively corresponding to the types of internal units in said paper feeding cassette case, said detecting member and each of said detecting member mounting portions are provided with mounting means for detachably mounting said detecting member on said detecting member mounting portion, and said mounting means provided for the detecting member mounting portion corresponding to said internal unit of a universal type has a structure in which said detecting member is allowed to slide in the range of the detecting member mounting portion.

2. The paper feeding cassette according to claim 1, wherein said internal units are of two types: an internal unit for envelopes for setting envelopes and an internal unit for plain paper sheets serving as an internal unit of a universal type in which two or more types of plain paper sheets of different sizes can be set.

3. The paper feeding cassette according to claim 1, wherein said detecting member is a magnet.

4. The paper feeding cassette according to claim 1, wherein said mounting means provided for said detecting member and each of said detecting member mounting portions comprise an engaging claw provided for said detecting member and an engaging hole provided for said detecting member mounting portion and detachably engaged with said engaging claw, the engaging hole provided for the detecting member mounting portion corresponding to said internal unit of a universal type being a long narrow hole so extend in a predetermined direction that said detecting member is allowed to slide in a state where said engaging claw is engaged with said engaging hole.

5. A paper feeding cassette case in an image forming apparatus to which an arbitrary internal unit out of an internal unit for plain paper sheets having a structure in which paper sheets of a plurality of sizes requiring the switching of the printing ranges can be set and an internal unit for envelopes for setting envelopes can be attached and on which a detecting member for giving indications of the type of internal unit and the size of paper sheets to the main body of the image forming apparatus is mounted, wherein detecting member mounting portions are respectively formed in different positions respectively corresponding to said two types of internal units in said paper feeding cassette case, said detecting member and each of said detecting member mounting portions are provided with mounting means for detachably mounting said detecting member on said detecting member mounting portion, and said mounting means provided for the detecting member mounting portion corresponding to said internal unit for plain paper sheets has a structure in which said detecting member is allowed to slide toward different positions corresponding to the sizes of paper sheets which can be set in said internal unit for plain paper sheets in the range of the detecting member mounting portion.

6. The paper feeding cassette according to claim 5, wherein said detecting member is a magnet.

7. The paper feeding cassette according to claim 1, wherein said mounting means provided for said detecting member and each of said detecting member mounting portions comprise an engaging claw provided for said detecting member and an engaging hole provided for said detecting member mounting portion and detachably engaged with said engaging claw, the engaging hole provided for the detecting member mounting portion corresponding to said internal unit for plain paper sheets being a long narrow hole so extend in a predetermined direction that said detecting member is allowed to slide in a state where said engaging claw is engaged with said engaging hole.

* * * * *